United States Patent [19]

Swingley, Jr.

[11] Patent Number: 4,588,087

[45] Date of Patent: May 13, 1986

[54] FRUIT CONTAINER

[75] Inventor: Harold E. Swingley, Jr., Monona, Wis.

[73] Assignee: Menasha Corporation, Neenah, Wis.

[21] Appl. No.: 567,739

[22] Filed: Jan. 3, 1984

[51] Int. Cl.[4] ..... B65D 21/02; B65D 1/22

[52] U.S. Cl. ..... 206/509; 220/21; 220/66; 220/72; 220/DIG. 6

[58] Field of Search ..... 206/509; 220/21, 66, 220/72, 83, DIG. 6

[56] References Cited

U.S. PATENT DOCUMENTS

| | | | |
|---|---|---|---|
| D. 233,020 | 10/1974 | Torokvei . | |
| D. 237,686 | 11/1975 | Torokvei . | |
| D. 246,633 | 12/1977 | Torokvei . | |
| 1,830,491 | 11/1931 | Swift, Jr. . | |
| 2,589,452 | 3/1952 | Stevenson | 220/21 |
| 2,609,956 | 9/1952 | Stevenson . | |
| 3,056,494 | 10/1962 | Reifers . | |
| 3,106,308 | 10/1963 | Kazimier | 220/21 |
| 3,283,943 | 11/1966 | Cargnelutti | 206/509 |
| 3,331,529 | 7/1967 | Slapnik . | |
| 3,481,502 | 12/1969 | Slayman . | |
| 3,489,274 | 1/1970 | Hughes . | |
| 3,575,311 | 4/1971 | Etienne . | |
| 3,902,599 | 9/1975 | Stromberg | 220/DIG. 6 |
| 3,905,478 | 9/1975 | Peterson | 220/72 |
| 3,998,327 | 12/1976 | Box | 206/509 |
| 4,029,209 | 6/1977 | Frahm | 220/21 |
| 4,040,517 | 8/1977 | Torokvei . | |
| 4,194,626 | 3/1980 | Boller | 206/509 |
| 4,293,080 | 10/1981 | Letica | 220/72 |

FOREIGN PATENT DOCUMENTS

| | | | |
|---|---|---|---|
| 1540364 | 8/1968 | France | 220/21 |
| 704251 | 2/1954 | United Kingdom | 220/21 |

*Primary Examiner*—George E. Lowrance

*Attorney, Agent, or Firm*—Quarles & Brady

[57] ABSTRACT

A molded plastic fruit container is constructed to provide ventilation without uncontrolled drippage into a lower container by virtue of bottom openings surrounded by raised rims, side openings that terminate above the bottom, and end weep holes to direct drippage away from a lower stacked container. The end walls are each provided with an end reinforcing rib grid that has gusseted horizontal ribs that extend further outwardly for improved engagement with a mechanical gripper. A bottom reinforcement rib grid is inset from a rim circumscribing the bottom so that the bottom rib grid is receivable in a lower container for secure stacking. The ribs of the bottom rib grid have ramped ends to allow an upper container to be swept off easily. The transverse ribs underneath the bottom openings are cut away to maintain ventilation and allow stacking with a conventional wooden crate.

6 Claims, 7 Drawing Figures

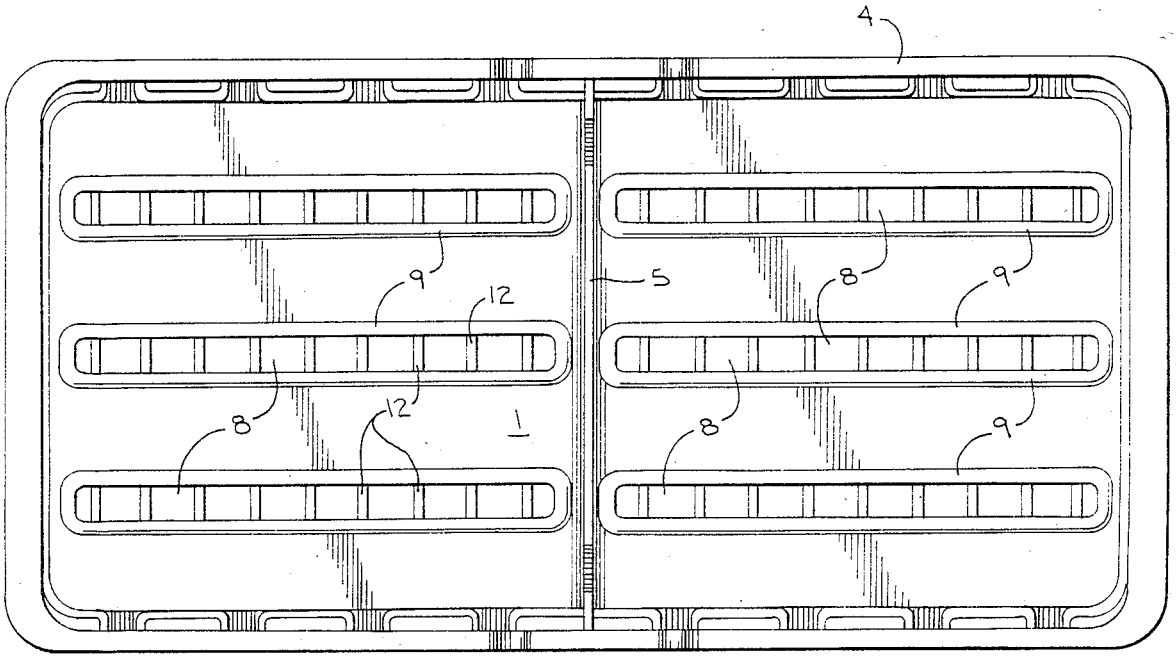
FIG. 2
FIG. 3
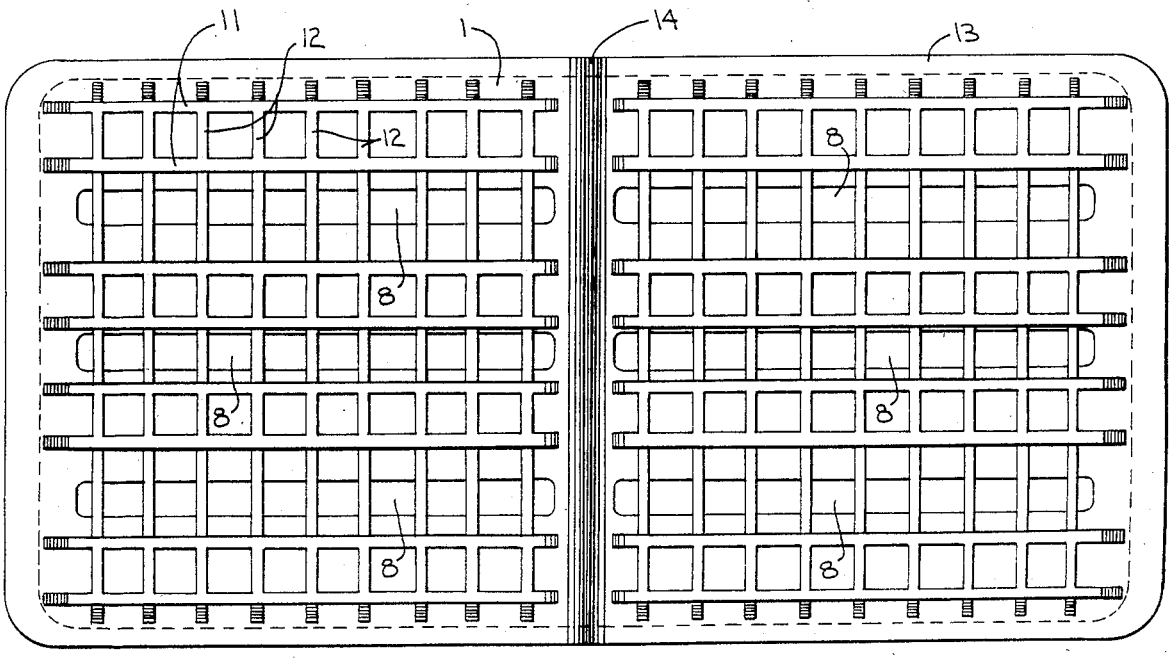

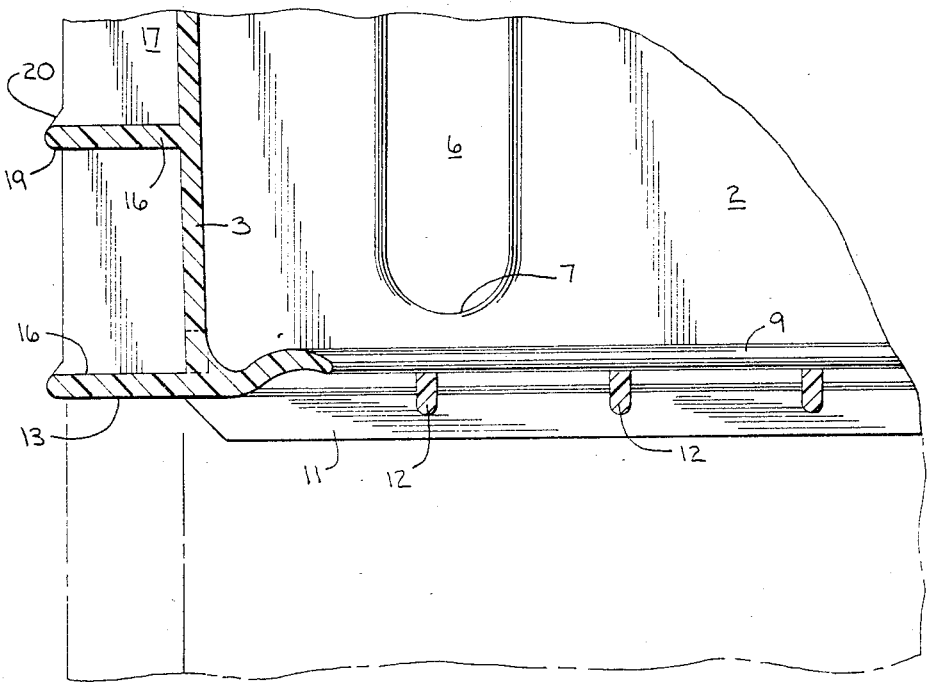
FIG.5
FIG.6
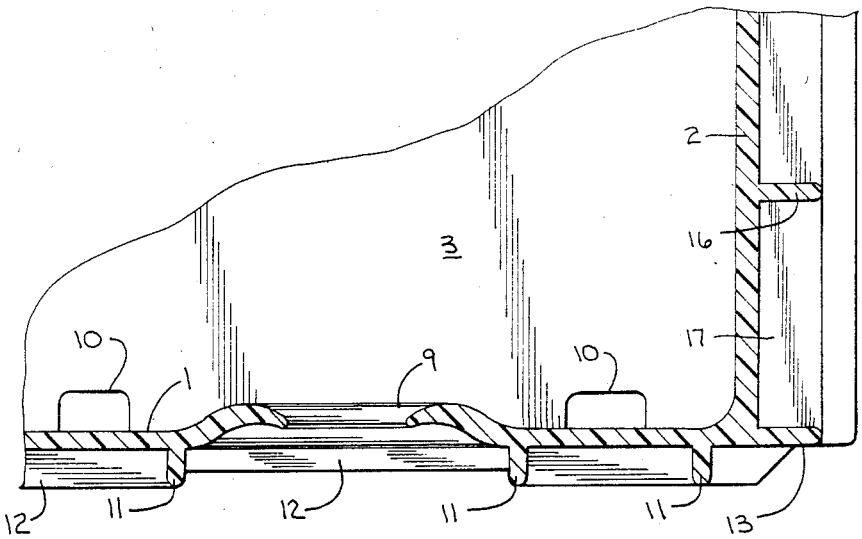
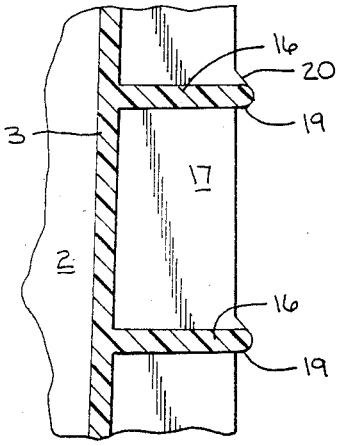
FIG. 7

FRUIT CONTAINER

BACKGROUND OF THE INVENTION

This invention relates, but is not necessarily limited to, plastic containers for transporting fruit.

Fruit is now commonly transported in wooden crates constructed of spaced slats to provide ventilation and thus help retard fruit spoilage. Such crates are, however, subject to a number of disadvantages. One such disadvantage is that wooden fruit crates are usually stacked and the lateral spacing between the bottom slats of an upper container allows drippage from spoiled fruit within the upper container to enter and spoil the fruit in a lower container. Further, wooden crates do not necessarily stack well, particularly those with relatively high central dividers, and such wooden crates may not withstand handling by mechanical gripper arms now commonly used in processing or shipping facilities. Still further, wooden crates usually have sharp interior corners that can easily cut or damage the fruit. Mold spores from rotting fruit are likely to be retained in the pores of the wood to accelerate spoilage of fruit subsequently shipped in the same container.

Plastic containers have been used to transport fruit, but known plastic containers do not overcome all of the foregoing problems.

SUMMARY OF THE INVENTION

The preferred embodiment of this invention is directed to a molded plastic fruit container which incorporates a number of features to overcome the indicated deficiencies of prior art fruit containers.

One particularly important feature of the molded plastic fruit container of the present invention is the provision of bottom ventilation openings that are each surrounded by a raised rim to minimize drippage into lower containers in a stack. Ventilation slots are provided in the side walls and terminate above the raised rims on the bottom of the container for the same purpose. Weep holes are, however, provided through the end walls below the raised rims on the bottom of the container to allow the drippings from spoiled fruit to drain away from the upper container to avoid having the dripping enter a lower container to contaminate the fruit therein.

Another important feature of the fruit container of the present invention is the provision of a downwardly extending reinforcing rib grid on the container bottom that is laterally inset from a rim formed about the circumference of the bottom by the lowermost horizontal rib on each of the side and end walls. The bottom reinforcing rib grid is receivable in the open top of the lower container to limit a lateral movement of an upper container relative to the lower container to assure secure container stacking. The ribs running crosswise beneath the bottom openings are cut away to maintain ventilation through the bottom openings. A central transverse channel is provided in the container bottom so that the container can readily be stacked onto a conventional wooden crate having a high central divider. Further, the ends of the ribs of the bottom reinforcing rib grid are ramped to allow an upper container to be swept off a lower container without the need to lift the upper container. Hand holes are provided in each of the side walls to allow tilting of a stack of containers to facilitate transportation of the container stack by a hand truck or the like.

Still another important feature is the provision of outer end reinforcing rib grids on the container end walls that allow the container to withstand handling by conventional mechanical, vertically-oriented gripper arms having rubber facings. The horizontal ribs of the reinforcing rib grid on each of the end walls are gusseted and extend further outwardly than the vertical ribs to provide a horizontal ledge to better engage the rubber facing of the gripper arm and assure more secure gripping.

Still further, all interior corners of the container are radiused to minimize the likelihood of cutting or damaging fruit, and the container is preferably formed from a high density plastic to minimize the retention of mold spores.

Other features, objects and advantages will appear from the description to follow. In the description, reference is made to the accompanying drawings which show, by way of illustration and not limitation, a preferred embodiment of the invention.

BRIEF DESCRIPTION OF THE DRAWINGS

FIG. 2 is a top plan view of the container of FIG. 1;

FIG. 3 is a bottom plan view of the container of FIG. 1;

FIG. 5 is a fragmentary view of a cross section through the plane 5—5 shown in FIG. 4;

FIG. 6 is an enlarged fragmentary view in cross section through the plane 6—6 shown in FIG. 1; and FIG. 7 is an enlarged fragmentary view in cross section through the plane 7—7 shown in FIG. 1.

DESCRIPTION OF THE PREFERRED EMBODIMENT

Figure 1:
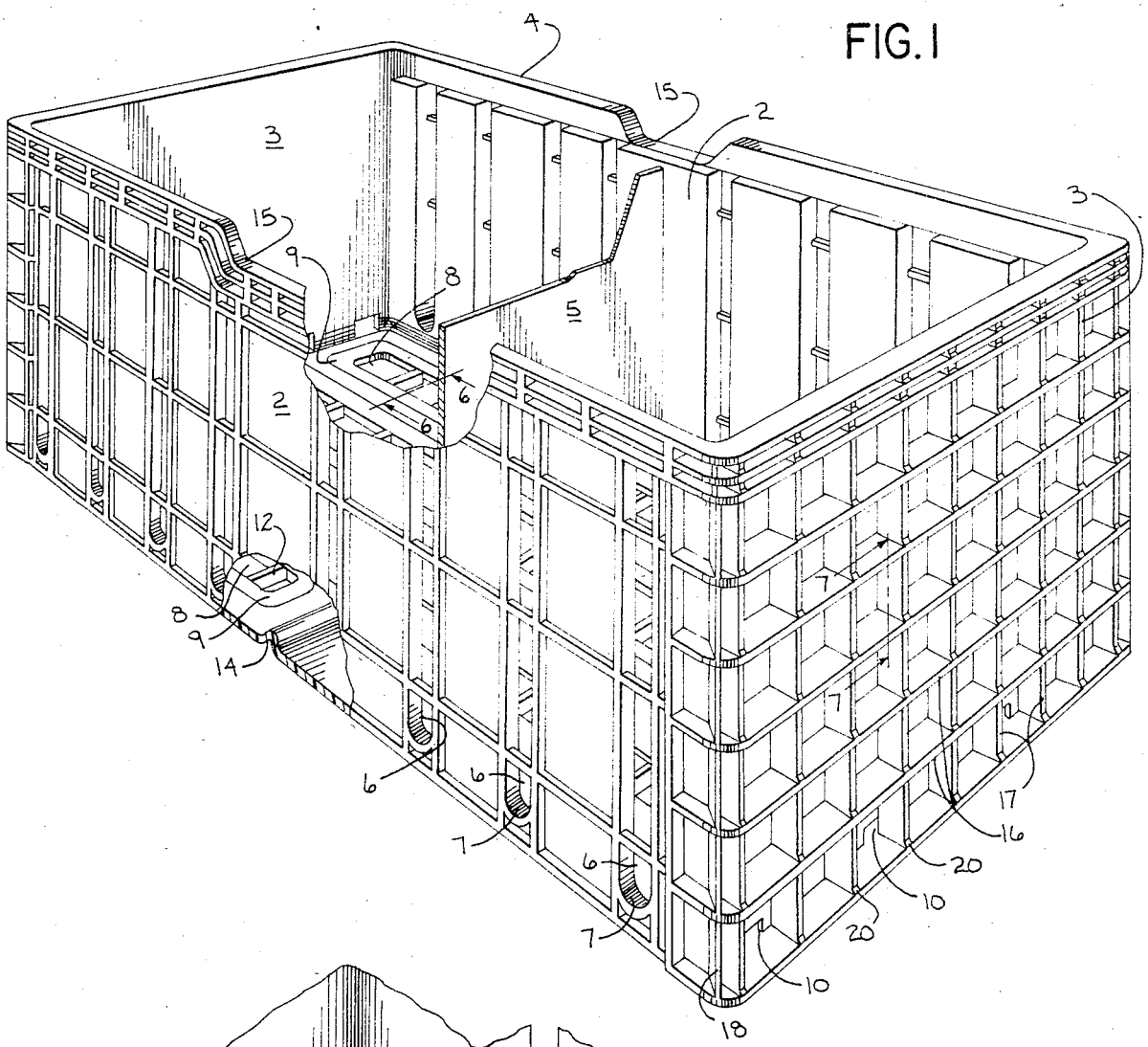
FIG. 1 is a perspective, partially broken away view illustrating a fruit container constituting a preferred embodiment of the invention.

Referring particularly to FIGS. 1–3, there is shown an improved fruit container constructed in accordance with the teachings of the present invention. The container is generally rectangular and is typically molded from a high density plastic so as to have a bottom wall 1, side walls 2 and relatively shorter end walls 3. The high density plastic bottom, side and end walls are not only strong, but are also practically impervious to mold spore penetration, a problem inherent in wooden fruit containers. The side and end walls 2,3 are slightly outwardly tapered from bottom to top and rise to the same level, where they are outwardly turned to define a peripheral upper rim 4. A central divider 5 extends transversely between the side walls 2 so as to be intermediate the end walls 3. The top of the divider 5 is set below the rim 4 and the top of the divider is also provided with an elongated notch therein for reasons which will be better understood hereinafter.

The side walls 2 are ribbed in any suitable configuration for strength, and are provided with vertical side wall ventilation slots 6, each slot 6 having a bottom end 7 that is above the horizontal plane of the bottom wall 1.

The bottom wall 1 is provided with bottom ventilation slots 8, which can be arranged in any suitable pattern. As can be seen most clearly in FIGS. 4–6, each slot 8 is completely surrounded by a raised peripheral rim 9. The ventilation slots 8 appear effectively raised with respect to the bottom 1. The end walls 3 are provided with a suitable number of weep holes 10 that are at the level of the bottom wall.

The slots 6 and 8 provide substantial ventilation to retard spoilage. Since the bottom edges 7 of the side wall slots 6 are typically above the level of weep holes 10, drippage from fruit that should happen to spoil will not escape through the side wall slots 6. The raised rims 9 prevent drippage through the bottom slots 8 except only for the limited drippage that might occur from fruit directly above the bottom slots 8. Drippage that may accumulate on the bottom wall will instead pass out through the weep holes 10 which lead away from the container. The net result is that the likelihood of significant drippage of spoiled fruit from an upper container to the next lower container in the same stack is minimized to reduce the likelihood of rotting the fruit in the lower container while still providing adequate ventilation.

Figure 4:
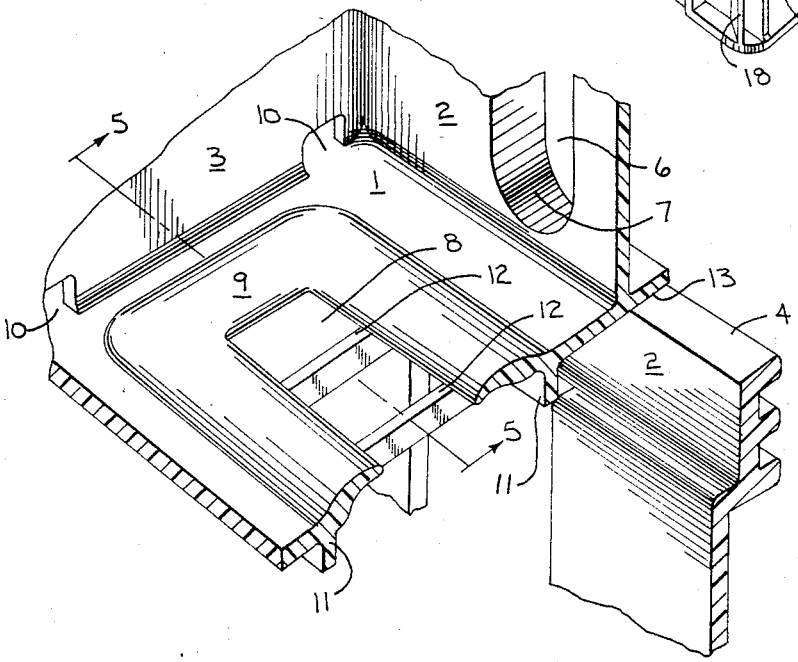
FIG. 4 is an enlarged fragmentary perspective view of the container of FIG. 1 illustrating bottom and side ventilation openings and end weep holes.

As can be seen most clearly in FIG. 3, the outer or bottom surface of bottom wall 1 is provided with a downwardly extending reinforcing rib grid comprising longitudinal ribs 11 and transverse ribs 12. The ribs 11, 12 extend across substantially the entire surface of the bottom wall 1. The ends of the ribs 11 and 12 stop short of a rim 13 which as best illustrated in FIGS. 4 and 6 is formed about the periphery of the bottom wall 1 by the lower-most one of the horizontally disposed ribs of the rib grid on the side walls 2 and the rib grid on the end walls 3, described later. Stated another way, the ribs 11 and 12 are inset laterally from the rim 13. As can be seen in FIG. 4, when two containers are stacked, the bottom rim 13 of the upper container will rest on the rim 4 of the lower container to support the upper container. The ribs 11, 12 of the upper container will then be disposed in the open upper portion of the lower container and will engage with the interior surfaces of the end walls 3 and side walls 2 of the lower container to limit lateral movement of the upper container in any direction and thus provide secure stacking.

As can now be appreciated, the notch in the top of the central divider 5 allows the ribs 11, 12 on the bottom 1 of the container to be received in the top opening of a lower container in stacked relationship without interference from the divider 5.

As can be seen in FIGS. 5 and 6, the ends of the ribs 11, 12 are ramped at approximately a 45° angle. This makes it possible to push or sweep an upper container off a lower container, as opposed to having to lift the upper container high enough so that the ribs 11, 12 can clear the rim 4 of the lower container.

Referring to FIGS. 4 and 6, it can be seen that those portions of the transverse ribs 12 that extend across the bottom vent slots 8 are cut away. That is to say, they are of a depth less than the depth of the longitudinal ribs 11. When the container is set on a flat, solid surface, the cut away portion of the tranverse ribs 12 provides a gap that insures adequate ventilation through the slots 8. Referring to FIGS. 1 and 3, the bottom wall 1 is shaped, and the ribs 11, 12 are cut away, to define a channel 14 that extends transversely across the bottom surface of the bottom wall 1 medially between end walls 3. The channel 14 is provided to accommodate the central divider of a conventional wooden crate, which usually extends up to and sometimes beyond the top edge of the wooden crate. Thus, the channel 14 in the bottom wall 1 allows the container of this invention to be stacked with such crates.

Turning once again to FIG. 1, notches 15 are provided in the rim 4 at the top of each of the side walls 2, so as to be directly above the divider 5 to allow the entry of the user's hand into one of the containers of a stack of containers to allow the user to tilt the stack. In this way, a stack of containers can be readily moved by a two wheel hand truck. By providing the notches 15 directly above the divider 5, the additional sidewall rigidity afforded by the divider may be advantageously relied upon.

Referring to FIGS. 1 and 7, the external surfaces of each of end walls 3 is provided with a reinforcing rib grid comprising horizontal ribs 16 and vertical ribs 17. The horizontal ribs 16 wrap around the corners of the end walls 3 to join the vertical corner ribs 18 (only one of which is shown), thus strengthening the corners of the container. The ribs 16 and 17 provide reinforcement for the end walls and allow the container to withstand handling by conventional mechanical gripper arms. Such arms are usually vertically oriented and are provided with rubber pads on their interior faces that bear against the container end walls 3. To further insure effective handling of the container by such gripper arms, the horizontal ribs 16 extend further outwardly than the vertical ribs 17, as the result of which, they will extend into the rubber facing of the gripping arm and develop what amounts to transverse support ledges 19. To provide added mechanical strength, there are upper gussets 20 at the intersections of the ribs 16, 17.

The container is molded so that all interior corners of the container have a significant radius to minimize the likelihood of cutting or damaging fruit in the container. As previously indicated, the use of high density plastic material also minimizes porosity and likelihood of retaining molded fruit spores that could contaminate later shipments.

While a preferred embodiment of the invention has been shown and described, it will be apparent various modifications might be made without departure from the scope or spirit of the invention. Obviously, the overall configuration of the container, ribs and slots can be varied to suit particular desires or requirements. While the container of the invention is designed particularly for transporting fruit, it could be equally useful for transporting other perishable or even non-perishable items. In view of the foregoing and other possible variations, the invention is not intended to be limited by the showing or description herein, its scope being established by the appended claims.

I claim:

1. In a container for fruit or the like that is made of substantially impervious material and includes a horizontal bottom wall completely circumscribed by vertical side and end walls, the improvement wherein:

at least one elongated ventilation opening is formed through the bottom wall and is completely surrounded by a raised rib which extends above the level of the bottom wall;

there are a plurality of reinforcing ribs on the lower surface of the bottom wall that span the ventilation opening;

at least one weep hole is formed through a vertical wall, each said weep hole extending at least partially below the level of the raised rib; and the upper surface of the bottom wall outside of the raised rib is flat to define a channel so that fluid collected thereon will flow out through the weep holes rather than through the ventilation openings.

2. A container according to claim 1, wherein there is also at least one ventilation opening through a vertical wall with its lower end above the lowest level of the weep hole.

3. A container according to claim 1, and in which the outer surface of each of the end walls is provided with an outwardly extending reinforcing rib grid comprising vertical and horizontal ribs, wherein the horizontal ribs extend further outwardly at a given height than the vertical ribs at the same height to provide transverse support ledges for enhanced engagement with a vertical gripping mechanism.

4. A container according to claim 3, wherein the intersections of the vertical and horizontal ribs are provided with upper reinforcing gussets.

5. The invention according to claim 2, in which the outer surface of each of the end walls is provided with outwardly extending, intersecting horizontal and vertical ribs, wherein the horizontal ribs extend further outwardly at a given height than the vertical ribs at the same height to provide transverse support ledges for enhanced engagement with a vertical gripping mechanism.

6. The invention according to claim 5, wherein the intersections of the vertical and horizontal ribs are provided with upper reinforcing gussets.

* * * * *